US006315358B1

(12) United States Patent
Baru

(10) Patent No.: US 6,315,358 B1
(45) Date of Patent: Nov. 13, 2001

(54) COMPUTER WORK STATION

(76) Inventor: Eran Baru, 3 Alkalai Street, Tel-Aviv 62742 (IL)

( * ) Notice: Subject to any disclaimer, the term of this patent is extended or adjusted under 35 U.S.C. 154(b) by 0 days.

(21) Appl. No.: 09/463,399

(22) PCT Filed: Jul. 13, 1998

(86) PCT No.: PCT/IL98/00328

§ 371 Date: Jan. 28, 2000

§ 102(e) Date: Jan. 28, 2000

(87) PCT Pub. No.: WO99/04670

PCT Pub. Date: Feb. 4, 1999

(30) Foreign Application Priority Data

Jul. 28, 1997 (IL) ..... 121410

(51) Int. Cl.[7] ..... A47B 83/02

(52) U.S. Cl. ..... 297/170; 297/174; 297/172; 297/344.1; 297/327

(58) Field of Search ..... 297/170, 172, 297/174, 344.1, 217.1, 327, 328; 482/72, 96

(56) References Cited

U.S. PATENT DOCUMENTS 4,046,419 9/1977 Schmitt .
4,184,656 1/1980 Wakeley .
4,779,922 10/1988 Cooper .
4,840,000 6/1989 Grines .
4,915,450 4/1990 Cooper .
5,026,016 6/1991 Lisowski .
5,116,098 * 5/1992 Wooten ..... 297/170
5,961,179 * 10/1999 Dixon et al. ..... 297/174

* cited by examiner

*Primary Examiner*—Anthony D. Barfield
(74) *Attorney, Agent, or Firm*—Nixon Peabody LLP; Jeffrey L. Costellia

(57) ABSTRACT

A computer work station including a user seat and a monitor supporting tray positioned in front of the seat, comprising a first chassis unit having a first base, an elongated seat supporting member, a first varying mechanism for varying the location of the seat along the seat supporting member between a relatively reclining position and a relatively upright position, a second chassis unit having a second base, an elongated monitor supporting member, a second varying mechanism for varying the location of the monitor supporting tray between an uppermost position and a lowermost position, and a coupling mechanism for coupling the seat to the monitor supporting tray so that displacement of the seat toward a relatively reclining position results in the displacement of the monitor supporting tray toward the uppermost position and displacement of the seat toward a relatively upright position results in the displacement of the monitor supporting tray toward the lowermost position.

9 Claims, 5 Drawing Sheets

COMPUTER WORK STATION

TECHNICAL FIELD

The present invention refers to computers in general, and to work stations therefor, in particular.

BACKGROUND ART

In recent years more and more people spend an increasing amount of time in front of computers, either professionally or as Internet users. In order to meet the needs of this growing market, extensive thought has been given to devise convenient, space-saving stations or centers that will make user's position in front of the computer more comfortable and less tiresome. Such prior art is disclosed, for instance, in U.S. Pat. No. 4,915,450 and the references cited therein. These work station systems were, however, designed primarily for professional users, at offices, rather than for domestic environments.

It is thus the major object of the present invention to provide a low-cost, furniture-piece like, modular computer work station, that will present the required features mainly for the benefit of the users.

DISCLOSURE OF THE INVENTION

There is thus provided, according to the invention present, a computer work station including a user's seat and a monitor supporting tray positioned in front of the seat, comprising a first chassis unit having a first base, an elongated seat supporting member, and first varying means for varying the location of the seat along the seat supporting member between a relatively reclining position and a relatively upright position, a second chassis unit having a second base, an elongated monitor supporting member, and second varying means for varying the location of the monitor supporting tray between an uppermost position and a lowermost position, and coupling means for coupling the seat to the monitor supporting tray so that displacement of the seat toward the relatively reclining position results in the displacement of the monitor supporting tray toward the uppermost position, and displacement of the seat toward the relatively upright position results in the displacement of the monitor supporting tray toward the lowermost position.

BRIEF DESCRIPTION OF THE DRAWINGS

These and additional features of the invention will become more clearly understood in the light of the ensuing description of a preferred embodiment thereof given by way of example only with reference to the accompanying drawings, wherein.

BEST MODE FOR CARRYING OUT THE INVENTION

Figure 1:
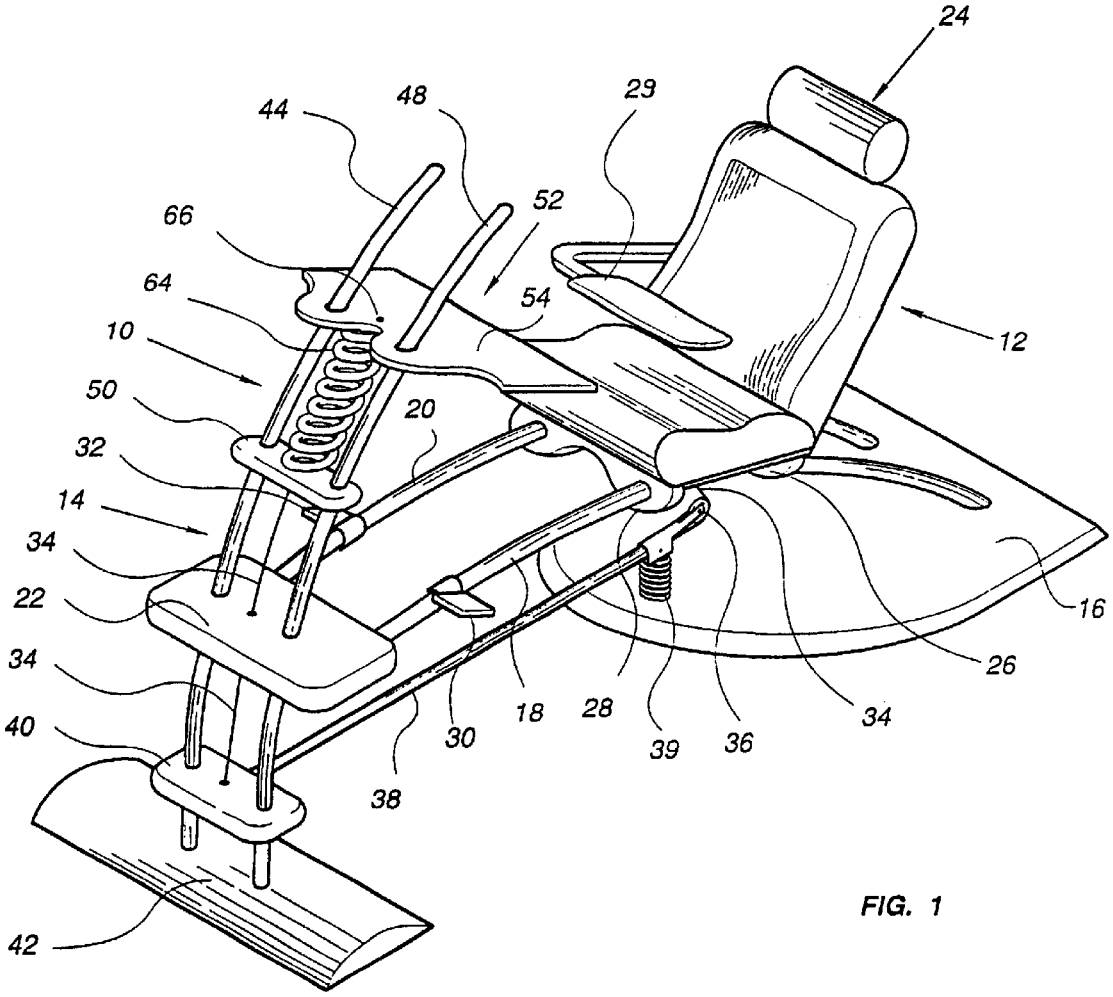
FIG. 1 is a front three-dimensional schematic representation of the work station according to a preferred embodiment of the invention.
Figure 2:
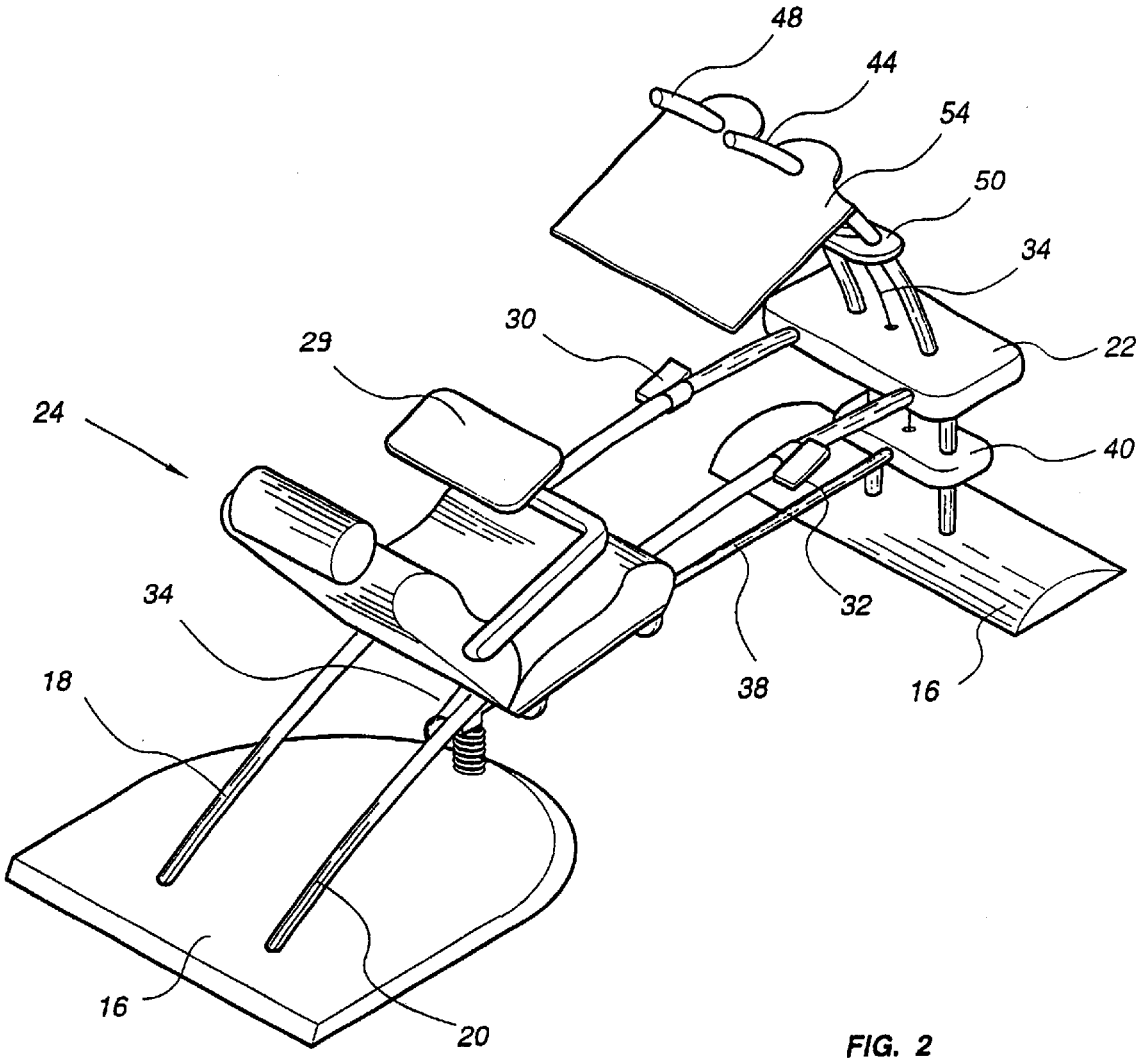
FIG. 2 is a rear three-dimensional schematic representation of FIG. 1.
Figure 3:
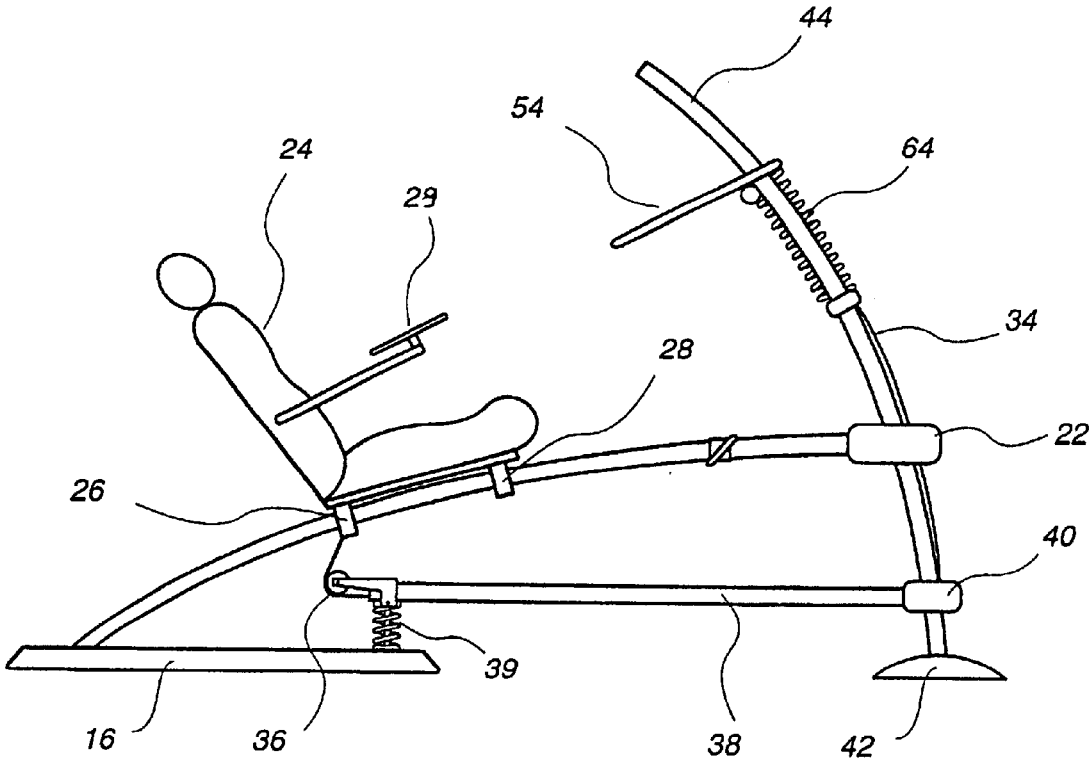
FIG. 3 is a side view of the work station of FIGS. 1 and 2.
Figure 4:
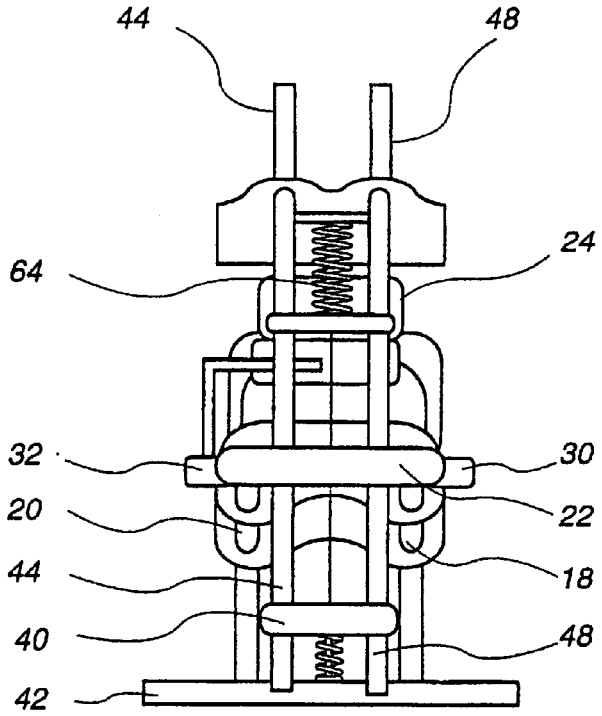
FIG. 4 is a front view of FIG. 3.
Figure 5:
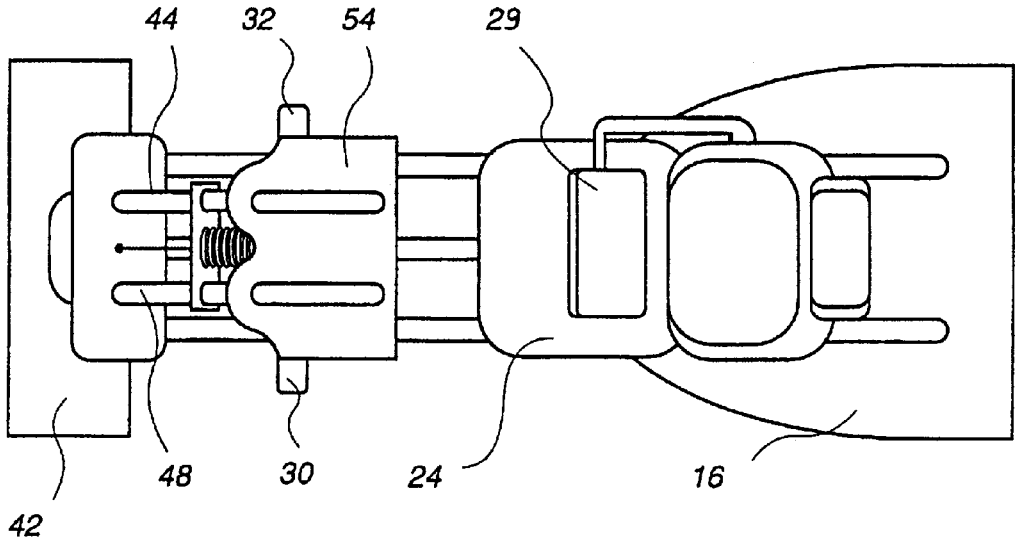
FIG. 5 is a rear view of FIG. 4.

The computer work station generally denoted 10 essential comprises two main assemblies: the seat carrying or supporting chassis or structure assembly generally denoted 12 and the monitor supporting structure generally denoted 14.

In the exemplified embodiment, assembly 12 comprises a base 16 carrying a pair of arcuate rails 18 and 20 extending generally in the direction of assembly 14 and connected thereto by a connector member 22. Preferably, the connection is of the quick dismantling type of any known design (not shown), for enabling the dismantling of the system into a kit form. The rails in the present example consist of tubular rods extending parallel to each other. A seat denoted 24 is slideable on rails 18 and 20 by being mounted on a carriage comprised of brackets 26 and 28, each formed with a pair of complementary openings through which arcuate rails 18 and 20 extend. This will allow the guided sliding movement of the seat, with an associated keyboard tray 29, up and down along the arcuate path. A pair of foot pedals 30 and 32 are provided on which the user's feet can rest and which are useful to apply, whenever requested, the force for pushing the seat away down the rails 18 and 20.

The seat carriage is coupled to a cable 34 wound around an idler roller 36 and passes through a tubular guiding member 38 connected at its one end to base 16 by a coupling comprising a coil spring 39 for a purpose to be explained further below. The other end of member 38 is releasably received by a bracket 40, mounted to monitor supporting structure 14.

Figure 7:
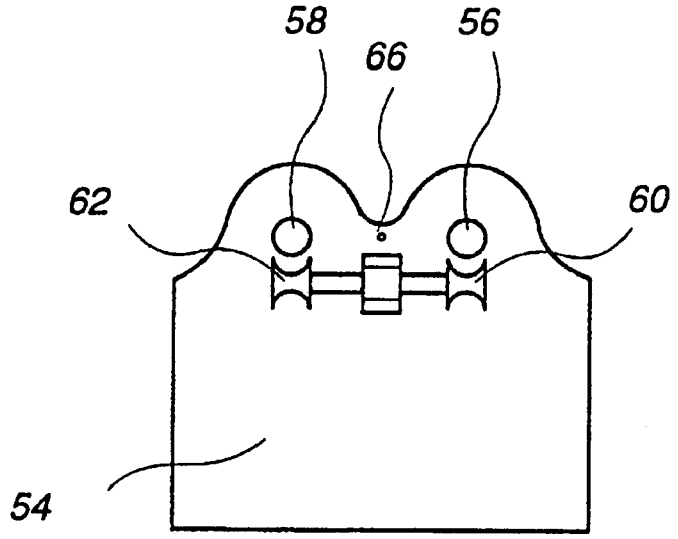
FIG. 7 is another detail of construction of the computer work station of FIG. 1.

Structure 14 comprises a base 42 and a pair of tubular, guide rails or rods 44 and 48. Rods 44 and 48 are again arcuate, extending parallel to each other, and—besides supporting the brackets 22 and 40 as aforesaid—carry a third bracket 50 being part of the monitor tray assembly designated 52. Monitor support tray 54 is free to slide on rails 44, 48 by being provided with a pair of openings 56 and 58 (see FIG. 7) as well as auxiliary rollers 60 and 62. Monitor support tray 54 is held in suspension or floating state against a compression coil spring 64, situated between bracket 50 and the bottom surface of monitor support tray 54 and thus is moveable downwards when pulled by cable 34 against spring 64 to change its location along rails 44 and 48, i.e., upon moving seat 24 toward the less reclining direction.

As seen, in FIGS. 1–5, cable 34 emerges from tubular guiding member 38, and extends upwards through brackets 22 and 50, and may be connected, by any means provided for this purpose—such as a hook 66, at the bottom side of monitor support tray 54.

Figure 6:
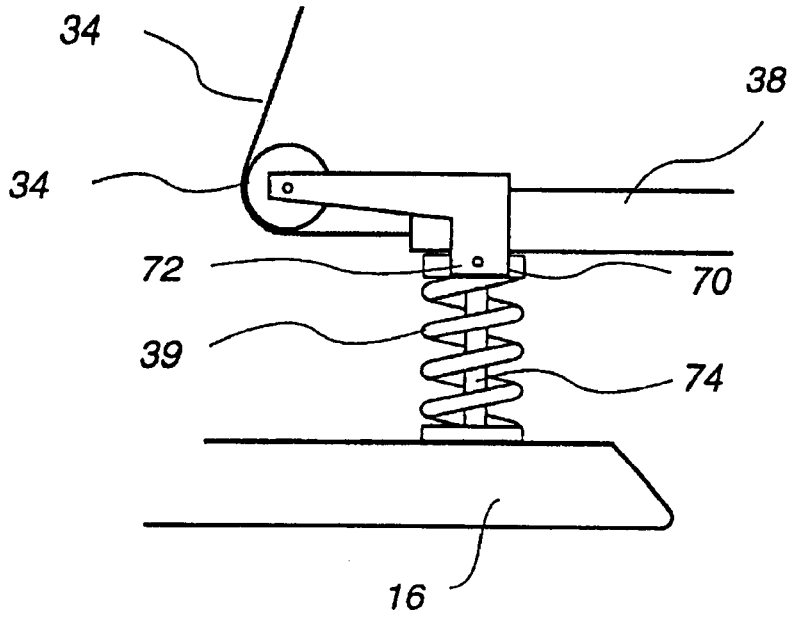
FIG. 6 shows a detail of construction of the work station of FIG. 1.

It will be further now indicated, with specific reference to FIG. 6, that tubular guiding member 38 through which cable 34 extends, is somewhat resiliently sustained by base 16, by means of spring 39, with cap 70 and pivot 72 on the one hand, and a tie rod 74 on the other hand, thus allowing an additional degree of freedom which is important to facilitate the assembly process of the work station 10 as a whole.

As will be now readily understood, the user sitting on seat 24 is able, by stretching his legs against pedals 30 and 32, to push seat 24 backwards, thereby relieving the initial pulling force applied to monitor support tray 54 and causing it to rise by sliding along rails 44 and 48 under the bias of the spring 64. Contrarily, when the user wants to revert from a reclining position into a more upright position, by sliding his seat forwards, the monitor and monitor support tray 54 will descend under the compression of spring 64 to a lower location, thereby adjusting the position of the display screen relative to his eyes.

Therefore, the arrangement as shown lends itself to various ergonomically different positions within certain predetermined limit, so that the user can exercise any position without having to stand up and apply adjustments to various other components of the work station.

It will be also noted that the construction of the computer work station is extremely simple, low-cost, can be supplied in kit-form to consumer, thereby still lowering the marketing price of the work station.

Various additional features will be readily apprehended, bearing in mind that modification or variation of the exemplified embodiment shall be deemed to be included within the scope of the invention and defined in and by the appended claims.

What is claimed is:

1. A computer work station including a user's seat and a monitor supporting tray positioned in front of the seat, comprising:

(a) a first chassis unit having a first base, an elongated seat supporting member in the form of at least one arcuate rail, and first varying means for varying the location of the seat along said seat supporting member between a relatively reclining position and a relatively upright position;

(b) a second chassis unit having a second base, an elongated monitor supporting member in the form of at least one arcuate rail, and second varying means for varying the location of said monitor tray supporting between an uppermost position and a lowermost position; and (c) coupling means for coupling the seat to said monitor supporting tray so that displacement of the seat toward said relatively reclining position results in the displacement of the monitor supporting tray toward said uppermost position, and displacement of the seat toward said relatively upright position results in the displacement of the monitor supporting tray toward said lowermost position.

2. The computer work station of claim 1, wherein said elongate seat supporting member comprises a pair of parallel, arcuate rails, and the seat is mounted to a carriage on the rails.

3. The computer work station of claim 1, wherein said elongate monitor supporting member comprises a pair of parallel arcuate rails slidingly supporting said monitor supporting tray.

4. The computer workstation of claim 3, wherein said monitor supporting tray is supported by a compression spring resting against a bracket affixed to said rails below said monitor supporting tray.

5. The computer work station of claim 4, wherein said coupling means comprise a cable connecting between said carriage and said monitor supporting tray.

6. The computer work station of claim 5, wherein said cable extends through a tubular guiding member mounted between said first base and said second base.

7. The computer work station of claim 5, wherein said cable is wound around an idler roller.

8. The computer work station of claim 7, wherein said idler roller is mounted onto a resilient console.

9. The computer work station of claim 3, wherein said monitor supporting tray is provided with a pair of auxiliary rollers engaging, respectively, said pair of parallel arcuate rails.

* * * * *